United States Patent [19]

Farrell et al.

[11] Patent Number: 4,974,742

[45] Date of Patent: Dec. 4, 1990

[54] CONTAINER WITH FOLDABLE HANDLES

[75] Inventors: Christopher J. Farrell, Arlington Heights; Thomas Hlobil, Fox River Grove, both of Ill.

[73] Assignee: American National Can Company, Chicago, Ill.

[21] Appl. No.: 462,572

[22] Filed: Jan. 9, 1990

[51] Int. Cl.[5] ..... B65D 25/28
[52] U.S. Cl. ..... 220/94 R
[58] Field of Search ..... 220/94 R; 212/100 A

[56] References Cited

U.S. PATENT DOCUMENTS

| | | | |
|---|---|---|---|
| 3,101,857 | 8/1963 | Freedman . | |
| 3,419,181 | 12/1968 | Stec . | |
| 3,542,236 | 11/1970 | Dru . | |
| 4,004,710 | 1/1977 | Crisci . | |
| 4,030,630 | 6/1977 | Yealy . | |
| 4,157,763 | 6/1979 | Betlejewski et al. | 220/94 R |
| 4,158,464 | 6/1979 | Bowen et al. . | |
| 4,478,348 | 10/1984 | Cook | 220/94 R |
| 4,593,833 | 6/1986 | Hill | 220/94 R |
| 4,827,562 | 5/1989 | Blasg et al. | 220/94 R |
| 4,832,293 | 5/1989 | Gizzi | 220/94 R |
| 4,856,673 | 8/1989 | Thompson | 220/94 R |

OTHER PUBLICATIONS

Patent Application Ser. No. 07/100,293 entitled "Container and seam ring for Container" filed on Sep. 22, 1987 by Christopher J. Farrell, Thomas Hlobil and George F. Nahill, Group Art Unit 241, Examiner S. Pollard.

Sales brochure of American National Can entitled "Food Packaging Will Never Be the Same Again . . ." (approximate date Jun. 1988).

Farrell, C. J. and Organ, J. R., "Shelf Stable Plastic Package Options for the Microwave," Activities Report of the R & D Associates vol. 40, No. 2, pp. 66–71 (1988).

*Primary Examiner*—Joseph Man-Fu Moy
*Attorney, Agent, or Firm*—Harry C. Engstrom; Paul R. Audet

[57] ABSTRACT

A container (20) suited to contain foodstuff has a handle assembly (41), a plastic body (22) and a metal closure (24) sealed to the plastic body (22) preferably by a double seam (60). The plastic seam ring (34) having a top portion (36) and inner and outer skirts (40, 38) descending therefrom is provided by itself or is mounted over the double seam (60) to conceal the metal of at least the double seam (60). A central panel (30) of the metal closure (24) bounded by a parting line (32) can be removed by the consumer to expose the contents of the container (20). The handle assembly (41) is attached to the inner skirt (40) at a base (76) and includes a central member (78) attached to the base (76). In storage, the handle assembly (41) is positioned within the inner skirt (40) of the seam ring (34). The handle assembly (41) and has two handles (80) that are attached to the central member (78) at hinges (86, 88). Additional hinges (94, 96) are located between the base (76) and the central member (78) to allow the handle assembly (41) to be pivoted from within the inner skirt (40) over the top portion (36) and against the outer skirt (38). The handles (80) may then be folded about the central member (78) at the hinges (86, 88) to form a means by which a consumer may grip the container (10).

50 Claims, 4 Drawing Sheets

CONTAINER WITH FOLDABLE HANDLES

FIELD OF THE INVENTION

The present invention pertains generally to the field of packaging and containers, and particularly to food containers having handles attached thereto.

BACKGROUND OF THE INVENTION

In the area of food packaging, a considerable market has developed for containers in which food may be heated for direct consumption. Such containers therefore represent a sort of disposable cookware/dishware combination. Today's food containers must be attractive in appearance, easy to use, not messy, pleasant to eat out of and, increasingly importantly, microwavable.

As in conventional dishware, it is advantageous for a food container to include some sort of handle for the user to grip or hold while eating the cooked contents of the container, or otherwise handling the container. However, when such handles are attached to, and protrude from, an outside wall of the container, a significant loss of usable packing space results when the containers are packed for transportation to grocery stores, vending areas, etc. Shelf space would be similarly lost at the point of sale. In some containers, packing space that would be dedicated to the containers and their contents is taken up by handles.

Handles attached to the outside of the container may also detract from an otherwise streamlined and attractive packaging appearance. Inasmuch as the container is bought for its contents, however, the consumer should not be led to believe that a large proportion of the purchase price is reflected in the container or the handles.

Accordingly, a need has developed for a handle arrangement that allows for an attractive container appearance but is economical to manufacture. The handles should preferably take up a minimum of packing space and be easy to hold to prevent messes and spillage.

SUMMARY OF THE INVENTION

In accordance with the present invention, a container with foldable handles includes a plastic container body having a top peripheral edge portion defining the top opening of the container body and a metal closure sealed, secured, seamed, or joined to the container body at its top peripheral edge portion. The closure has means, such as a parting line, score line, or line of weakness which defines an inner panel that can be removed from the remainder of the closure. The closure is preferably a full panel easy opening closure joined to the container body, preferably by a double seam to provide a proven, high integrity hermetic seal.

The container also may include a seam protective ring, referred to herein as a seam ring, that is integrally formed with a handle assembly and mounted over the seam between the closure and the container body, among other reasons, to cover and conceal the seam and/or all or substantially all of the metal remaining on the container after the panel is removed. The seam ring has a top portion and inner and outer skirts descending dowardly from the top portion. To secure the seam ring in place over the seam, the outer skirt preferably has an inwardly facing bead formed on its inner surface preferably near its bottom peripheral edge. The inwardly facing bead is shaped to fit under the outwardly extending juncture, such as the seam of a crimp seam or of a double seam, to hold the seam ring in position on the container body. The inner skirt of the seam ring has an inner bottom edge which is spaced closely adjacent to the top surface of the closure at a position adjacent to the parting line of the closure such that the area of the central panel of the closure bounded by the parting or score line can be removed, if rigid, without undue interference by the inner skirt of the seam ring. In this manner the consumer is protected from the raw edge of the rim which remains attached to the container body. This is especially important for soups and the like where the consumer may want to drink directly from the container.

For containers having a seam ring, a handle assembly is attached to the inner skirt of the seam ring at a base. For containers which do not utilize a seam ring, the handle assembly may be attached directly to the body of the container near the top opening. In a storage position, the handle assembly is positioned within the inner skirt of the seam ring. The handle assembly includes a central member attached to the base, and two handles attached to opposing sides of the central member. Hinges are located between the base and the handle to allow the handle assembly to be pivoted from a position within the inner skirt of the seam ring to a position over the top portion and against the outer skirt of the seam ring. The handle assembly is pivoted to this latter position when in use by a consumer. There are additional hinges that attach each handle to the central member to allow the handles to fold out from a position in which both handles and the central member are planar to a position in which the handles are folded against each other about the central member. When the handles are thus folded, they may be conveniently gripped by a person eating or drinking out of the container.

Because of the foldable nature of the handles, the container of the present invention requires no additional shelf or storage space. The handles are economically manufactured and do not detract from the appearance of the packaging.

Further objects, features, and advantages of the invention will be apparent from the following detailed description when taken in conjunction with the accompanying drawings.

DESCRIPTION OF THE PREFERRED EMBODIMENT

Figure 1:
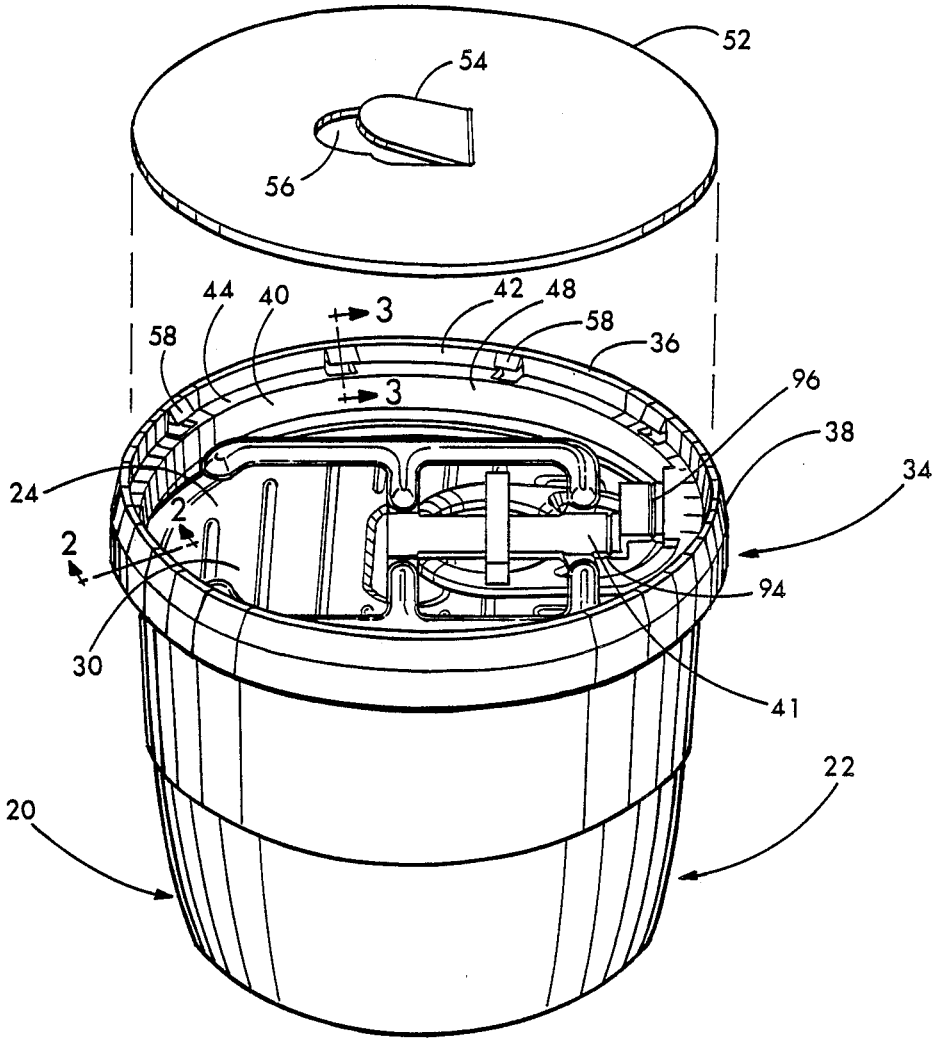
FIG. 1 is a perspective view of a container with folding handles of the present invention showing a splash panel spaced above the remainder of the container for illustrative purposes.

With reference to the drawings, a preferred embodiment of the container of the invention is shown generally at 20 in FIG. 1. The container 20 is comprised of a container body generally designated 22, preferably formed of plastic, which may have a bowl-like shape, as illustrated in FIG. 1, which is preferred where the product is to be used for heating in a microwave oven. This bowl-like shape includes a conventional or other bottom wall and an upwardly curved side wall as shown. Of course, the container body 22 may be single- or multi-layered and have any desired container configuration, including cylindrical, squared, oblong, rectangular, or polygonal. The container body 22 may be formed of multi-layer plastic as described in United States Pat. Nos. 4,407,897 and 4,526,821. A cover or closure 24, preferably formed of metal, is secured at a seal or seam to the top peripheral edge portion 26 of the container body 22 in a manner known to the art. As used herein, any juncture of two or more parts obtained by whatever means may be considered a seam. The closure 24 is preferably a full panel easy open closure having a pull tab 28 attached to it by which a user can pull up and tear off an inner or central panel 30 of the cover 24 which is circumscribed by means such as a line of weakness or score line defining a parting line 32 formed in the closure 24. As is conventional in this packaging technology, the closure 24 is preferably an integral unit which is impervious to both air and moisture until the user breaks the seal at the parting line 32 and removes the inner panel 30 of the cover 24.

Figure 3:
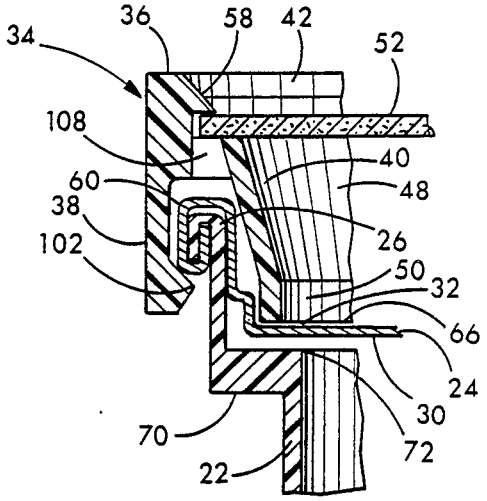
FIG. 3 is a cross section, with portions broken away, taken generally along the lines 3—3 of FIG. 1 with the splash panel shown in place in its secured position on the container.

In accordance with the present invention, the container 20 is also preferably provided with a seam protective ring 34, referred to hereafter as a seam ring, mounted on the top periphery of the container and covering the juncture between the metal closure 24 and the plastic container body 22. The word 'ring' as used herein is not limited in terms of size or shape, and may, for example, include a rectangular periphery or other polygonal periphery as well as circular. The seam ring 34 shown has a top portion here preferably illustrated as a ring shaped top portion generally designated 36, an outer skirt 38, and an inner skirt generally designated 40 descended therefrom. The seam ring 34 has a handle assembly 41 attached to the inner skirt 40 of the seam ring. The seam ring has an uppermost inwardly facing surface 42 and includes a horizontal, inwardly extending support ledge 44. The inner skirt 40 descends downwardly from the top portion 36. The inner surface of the seam ring 34 at the inner skirt 40 is composed of an upper section 48 and a lower marginal edge portion 50. The support ledge 44 is sized and shaped to support the outer peripheral edge portion of an appropriately shaped splash panel 52 (shown in FIG. 3) which may be formed of cardboard, paperboard, plastic, composites, or other suitable material and which may have a hinged tab 54 by which the splash panel 52 may be grasped and manipulated by the user. The tab 54 may be cut from the splash panel 52 as shown to leave a vent opening 56 in the splash panel 52. Preferably, this may be done by making a semi-circular cut to define the tab 54, and a second defining a loop starting and terminating on the first cut to define a small hole between the first and second cuts which forms the vent hole 56. The seam ring 34 preferably has means for removably holding the splash panel 52 to the seam ring 34, here shown as preferably including the support ledge 44 and a plurality of engagement lugs 58 which project inwardly from the inward facing surface portion 42 and which are spaced slightly above the top surface of the support ledge 44. The engagement lugs 58 are formed to project over a top surface edge portion of the splash panel 52 which are resting on the support ledge 44 and provide a means from restraining upward movement of the splash panel 52. Preferably, the spacing between the lugs 58 and the surface of the ledge 44 is slightly greater than the thickness of the splash panel 52 so that sufficient space is allowed for the edge portions of the splash panel 52 to bend over the lugs 58 during insertion of the panel 52 and then snap in under the lugs 58 even though the edge portions of the panel 52 may be bent at a slight angle. The resulting spacing of the underside of the lugs 58 from the top surface of the splash panel 52 as illustrated in FIG. 3, results in positive engagements of the lugs 58 to the splash panel 52 when the splash panel 52 is moved upwardly from the ledge 44. The lugs 58 can be of any number. Preferably, they have a downwardly and inwardly angled top surface to facilitate positioning of the splash panel 52 into engagement, and a substantially horizontal undersurface. It is within the scope of the present invention to have other sizes and shapes of lugs so long as they achieve the desired purpose of restraining upward movement of the splash panel 52.

Figure 2:
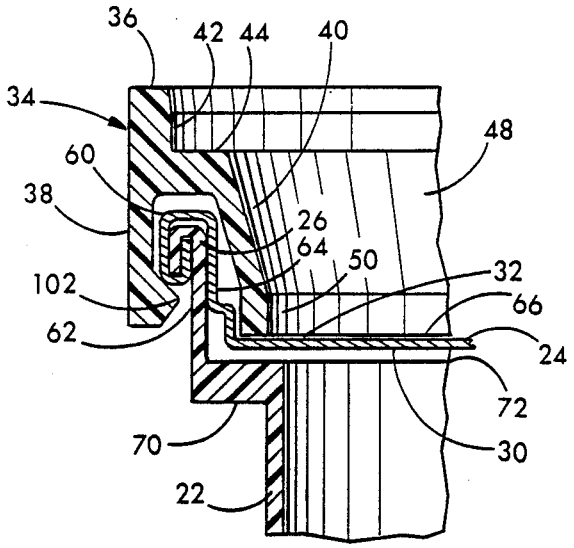
FIG. 2 is a cross section, with portions broken away, through the container of FIG. 1 taken generally along the lines 2—2 of FIG. 1.

As best shown in cross-sectional views of FIGS. 2 and 3, the closure 24 is joined, sealed, secured, or seamed to the top peripheral edge portion 26 of the plastic container body 22 by any suitable seam, preferably, as shown, by a double seam 60 which extends outwardly from the adjacent outer surface 62 of the container 20. For purposes of the invention disclosed herein, a seal or seam is defined as any juncture or joining together of two or more things, obtained by any suitable means. The outer surface of the double seam is formed by metal of the closure 24 and thus, when exposed to view, contrasts with the adjacent plastic material of the container body 22. The metal of the double seam extends over the top peripheral edge portion 26 of the container body 22. The top portion 26 and the spaced apart descending outer skirt 38 and inner skirt 40 of the seam ring 34, which define a channel between them, completely enclose and conceal the double seam and a countersink wall 64 of the closure, which descends from the top of the double seam, and the lip, rim, and the rest of the closure 24 which extends to and is outward of the parting line 32 in the horizontal portion of the closure. The bottom edge, here shown as its inner peripheral edge 66 of the inner skirt 40, terminates at a point touching or spaced above, preferably just above or close to, the top surface of the panel 30 and preferably just outwardly of the line 32 which circumscribes the removable panel in the closure 24. After the panel 30 is removed, as illustrated in the top view of FIG. 4, the lip portion 64 of the metal closure that remains will have an inner cut edge 68 at the parting line 32 which may be sharp and could potentially pose the risk of cutting or scraping a user's finger or lip when using the container 20. To minimize the likelihood of this occurring, the inner peripheral edge 66 preferably is in a position which protects the user from being injured on the cut edge 68. Also, preferably, the container body has a horizontal shelf 70 preferably provided in the container body 22 just beneath the cut edge 68 that remains on the container body 22. The shelf 70 has an inner edge 72 which preferably lies just beneath or slightly inwardly of the parting line 32. In addition, it is preferred that the inner edge 66 of the seam ring 34 terminate at a position just adjacent to the parting line 32 so that no substantial amount of the remaining metal of the closure 24 extends inwardly from the edge 66 which could cause injury to a user's finger, hand, or lip. Preferably, the inner edge 66 of the inner skirt 40 on the seam ring 34 is spaced relative to, preferably slightly outwardly from the parting line so that the seam ring 34 does not unduly interfere with the removal of the inner panel 30 from the closure 64, but is nonetheless sufficiently close to the parting line 32 that no substantial amount of metal remains exposed. A preferred outward spacing of the inner edge 66 from the parting line 32 is a distance which is such that the user's finger cannot exert sufficient pressure on the remaining exposed metal edge itself, because of the support provided by the adjacent plastic, to cut or scrape the skin. Preferably, this spacing may be less than twenty thousandths of an inch.

The handle assembly 41 is attached to the inner skirt 40 of the seam ring 34 at a base 76. It should be understood that the handle assembly may also be directly attached to the container body at a position near the top opening of the containers. As shown in FIG. 1, prior to use by the consumer, the handle assembly 41 is packaged so as to be positioned within the inner skirt 40 of the seam ring 34 between the closure 24 and the splashguard 52. The handle assembly is so designed that it supports the splash guard. When filled containers are stacked one above the other, this support keeps the splash guard from deflecting downwards out of the lugs 58. The handle assembly 41 includes a central member 78 that is attached to the base 76, the central member 78 extending inwardly and radially from the point at which the base 76 is attached to the inner skirt 40 of the seam ring 34. The handle assembly 41 comprises two handles 80 attached to opposing sides of the central member 78; each handle 80 includes a first strut 82 and a second strut 84 that extend perpendicular to the central member 78 and are attached to the central member 78 at hinges 86 and 88, respectively. The hinges 86 and 88 are "living hinges." A third strut 90 is oriented axially to the central member 78 and is joined to the first and second struts 82 and 84. The first and third struts 82 and 90 are joined to form a rounded edge so as to give the appearance of one continuous strut. The end 92 of the third strut 90 opposing the end joined to the first strut 82 is flared slightly.

Figure 4:
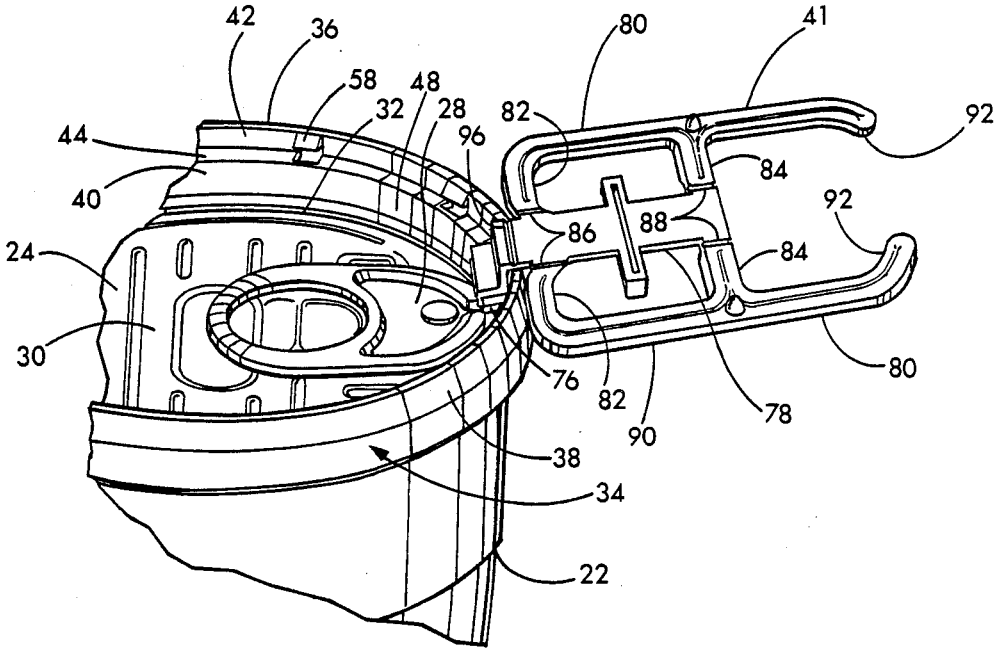
FIG. 4 is a perspective view, with portions broken away, of the container with folding handles of FIG. 1, the handles being pivoted away from the top opening of the container.
Figure 5:
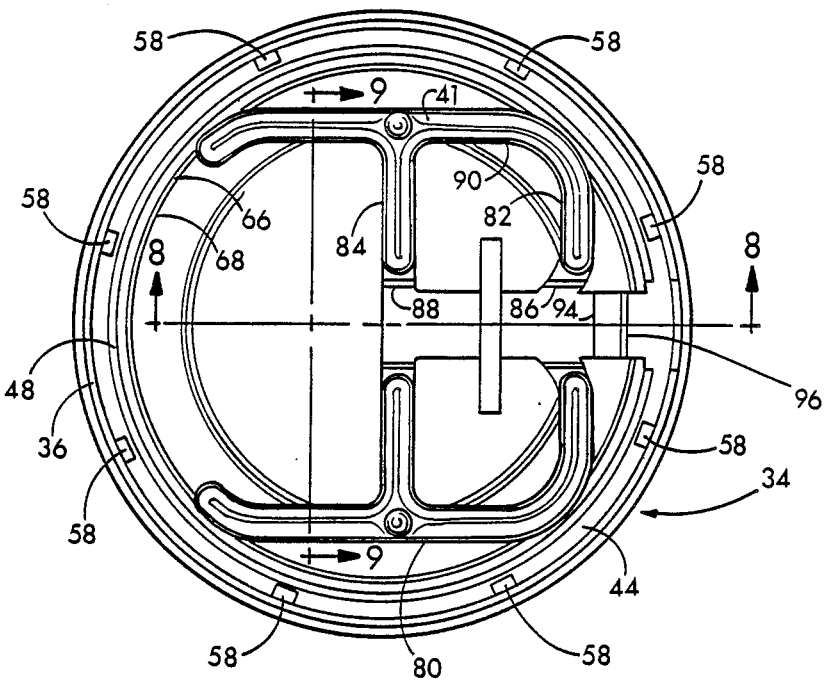
FIG. 5 is a top plan view of the container of FIG. 1 with the splash panel and the inner panel of the cover removed.
Figure 6:
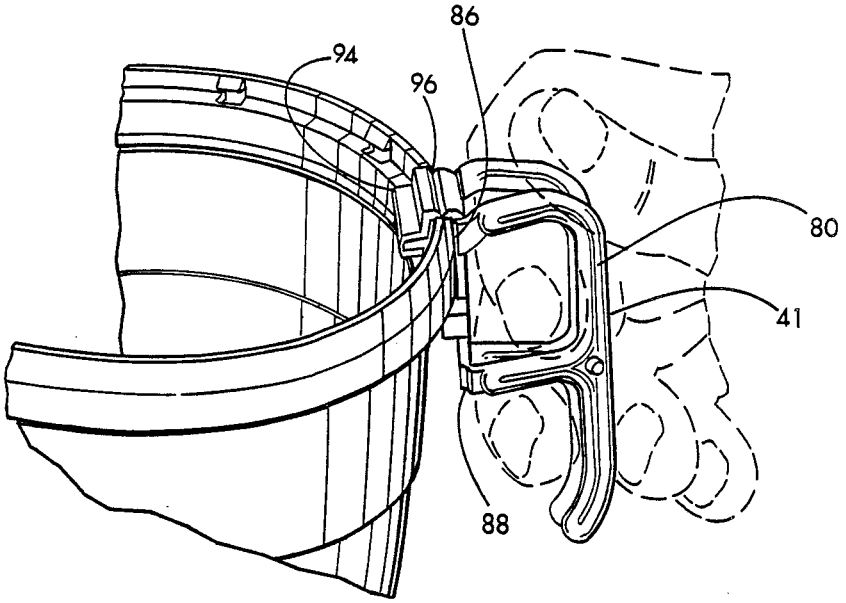
FIG. 6 is a perspective view, with portions broken away, of the container with folding handles of FIG. 1, the handles being pivoted away from the top opening of the container and folded into position about the central member for use.
Figure 7:
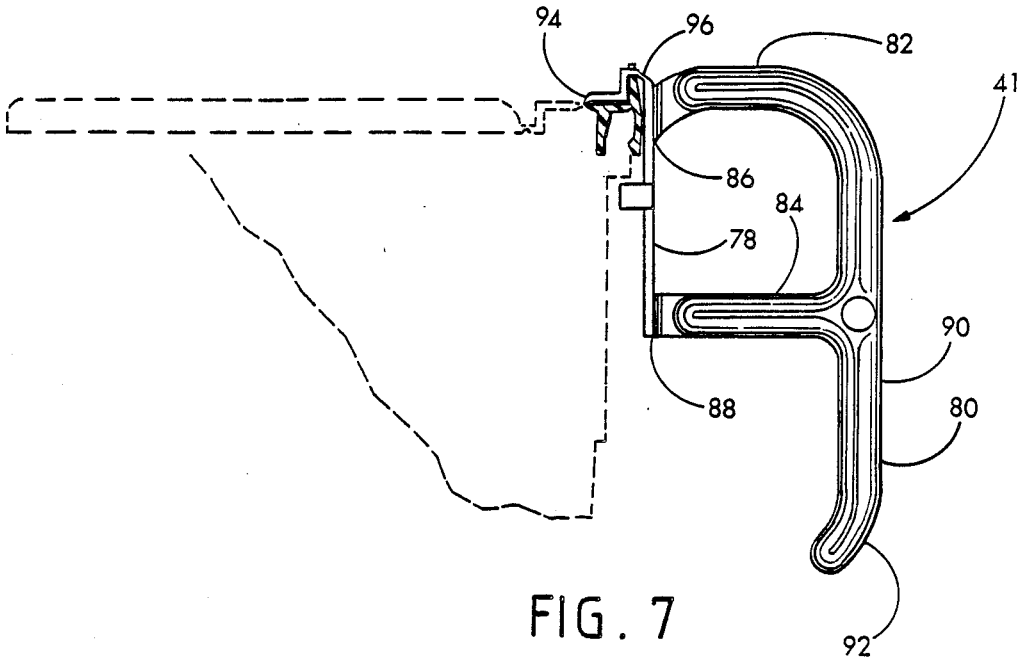
FIG. 7 is a side view of the container with folding handles of FIG. 1 with a section through the seam ring, the folding handles being pivoted away from the top opening of the container and folded into position for use and also showing the handle in storage position within the inner skirt of the seam ring in dotted lines.
Figure 8:
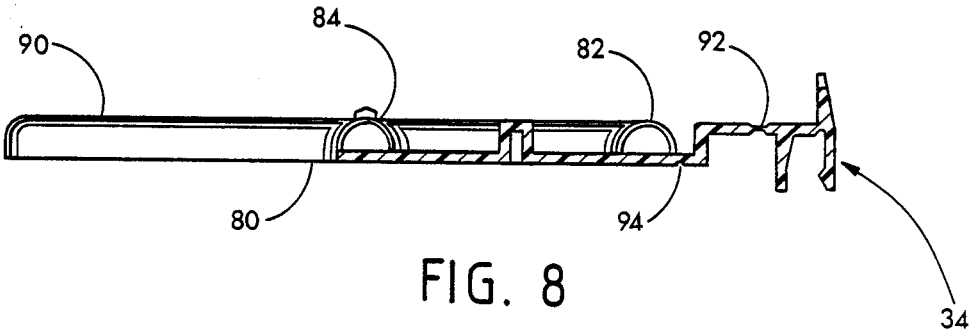
FIG. 8 is a cross section taken along the line 8—8 of FIG. 5.
Figure 9:
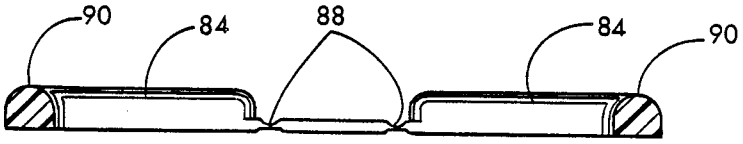
FIG. 9 is a cross section taken along the line 9—9 of FIG. 5.

There are two additional hinges 94 and 96 located between the base 76 and the central member 78. The hinges 94 and 96 are "living hinges." The hinge 94 allows the handle assembly 41 to be pivoted from within the inner skirt 40 of the seam ring 34 such as depicted in FIG. 4. The hinge 96 allows the handle assembly 41 to be pivoted over the top portion 26 and against the outer skirt 38 of the seam ring 34. In the latter position, the central member 78 abuts against the outer skirt 38 of the seam ring 34 and is depicted in FIG. 6. FIG. 6 further shows the two handles 80 being folded about the central member 78 at the hinges 86 and 88. Thus, upon removal of the splash panel 52, a consumer may pivot the handle assembly 41 at hinges 86 and 88 and fold the handles 80 at hinges 94 and 96 so that the handle assembly 41 forms a means by which the consumer may grip the container 10 while eating or drinking therefrom or otherwise handling the container 20. FIG. 6 shows a manner in which the handles 80 would be typically held or gripped by a user. The grip of the consumer is typically formed around the handles 80 such that the index finger is inserted through the spaces formed between the first, second, and third struts 82, 84, and 90. The flared end 92 of the first strut 82 keeps the middle finger from slipping off of the handles 80. In FIG. 7, the lateral strut attached to 78 fits under the shoulder of the container. This helps to prevent the container from twisting away from the handles when the assembly of FIG. 6 is lifted and tilted towards the mouth. Detailed and section views of the handle assembly 41 are shown in FIGS. 7, 8, and 9.

Means are provided on the seam ring 34 for securing the seam ring 34 to the container body 22. For example, an inwardly facing bead 102 is preferably provided on the inner surface of the outer skirt 38 and is shaped to fit under the outwardly extending bead of the double seam 60 on the container body 22, preferably to engage against it, to hold the seam ring 34 in position so that the seam ring 34 cannot be pulled upwardly once it has snapped into place. The inwardly facing bead 102 preferably has the angled surfaces as shown to best accommodate the snap fitting of the seam ring 34 over the double seam bead.

The plastic materials of which the seam ring may be formed are sufficiently resilient to be positioned over the seam such that the inner and outer skirts 40 and 38 can spread away from one another to allow the skirts to snap over the bead of the double seam 60, but will nontheless firmly hold the double seam 60 between them when they are fitted into place. The angled inner walls of the bead 102 on the outer skirt 38 are preferred also for ease of production of the seam ring 34 in injection molding equipment, and particularly to facilitate the removal of the molded part from the mold without requiring undue distortion of the molded seam ring during the removal process.

Preferably, an opening 108 in the support ledge 44 is formed directly beneath each of the lugs 58. The openings 108 are a consequence of the preferred manner of forming the lugs 58 as the seam ring 34 is molded in injection molding apparatus, wherein extended protrusions from one portion of the mold extend up to form the bottom surface of each of the lugs 58. The support ledge 44 is then formed as molding plastic flows about these protrusions. When the mold parts are withdrawn from one another and the protrusions are withdrawn from the lugs 58, the openings 108 are left in the bottom surface of the support ledge 44. As a consequence of this molding process, an indentation is formed in the inwardly facing surface 42 between the ledge 44 and each of the lugs 58. In this manner, the engagement lugs 58 may be formed by injection molding in a straightforward and efficient manner even though they form a sharply defined surface parallel to and preferably overhanging the support ledge 44 below. This sharply defined bottom surface of the lug 58 allows the edge of the splash panel 52 to be kept in position, held, or firmly engaged between the bottom surface of each lug 58 and the top surface of the support ledge 44. It is to be understood that although the opening 108 has been shown as completely encircled by the plastic of the seam ring, the opening 108 can continue through the inner skirt 40, forming a slot in the inner skirt 40 beneath the position of each lug 58 and serves the same function of facilitating the injection molding of the seam ring 34 with the lugs 58.

As best shown in FIG. 3, the splash panel 52 is supported on the support ledge 44 preferably a substantial distance above the inner panel 30 of the metal closure 24. The container 20 usually has a headspace but may, of course, be filled up to or near to the top edge 72 of the main portion of the container body 22. Thus, when the panel 30 of the cover 24 is removed, and the splash panel 52 is inserted and placed by the consumer when the product is to be heated in a microwave oven, the splash panel 52 will be supported by a significant distance, preferably 3/16 to a quarter of an inch or more, above the top level of the product, e.g., food stuff within the container 20. The space between the splash panel 52 and the product allows steam escaping from the sides to have a clear path to the center vent opening 56 in the splash panel 52. It is also allows for food expansion so that the venting path is not blocked and so that food itself is not expelled through the vent hole 58 onto the panel.

The closure 24 may be formed of any suitable metal such as those currently used in packaging including plated or coated steel, or aluminum, as desired, and foil plastic laminates. Aluminum generally will be heated less by induction in a microwave oven than steel, and thus may be preferred for microwavable containers where a residual metal rim is left on the opened container.

The material of the container body 22 may be selected of any suitable plastic or plastic surfaced composite material; for example, those currently used to form such containers, depending in part upon the process selected for forming the container body. The seam ring 34 and the handle assembly 41 is preferably integrally formed by injection molding and any of the various materials suitable for injection molding, successful utilization of the seam ring, and other preferred methods of manufacture may be utilized. For aesthetic compatibility between the seam ring 34 and the container body 22, it is preferred the seam ring 34 material match in color and texture of the material of the container body 22, although it is also possible, and sometimes constitutes a distinct advantage of the present invention, to have a seam ring of a different color than the container body to match trade dress colors of the packer or contribute to the visual impact of the completed product. Polypropylene is the preferred material because of its ability to withstand the repeated flexing of a "living hinge." However, because this is essentially a single use application, other materials with less flex resistance may be used. In particular, blends or co-polymers of polyolefins containing a polypropylene component are preferred because the plastic material should also have a heat distortion temperature higher than the temperature which the seam ring 34 will be heated to during microwaving. Preferably, the material has a heat deflection under flexural load (as defined in ASTM D648) above the boiling point of water. Those skilled in the art will be able to select suitable materials for forming the seam rings of this invention.

It is understood that the invention is not confined to the particular construction and arrangement of parts herein illustrated and described. For example, alternate embodiments may include a foldable handle or outer surface of a container neck, and handle per se, adapted to be utilized with various plastic containers having seamed-on (including crimped on) ends. The invention therefore embraces such modified forms thereof as come within the scope of the following claims.

What is claimed is:

1. A container comprising:

(a) a container body having a top peripheral edge portion defining the top opening of the container body and an outer surface;

(b) a closure sealed to the top peripheral edge portion of the container body and having an area thereof which is removable from the remainder of the closure;

(c) a plastic seam ring having a top portion and an outer skirt and an inner skirt descending from the top portion, the inner skirt having an inner bottom edge, the seam ring being mounted over the top peripheral edge portion of the container body, and means for securing the seam ring to the container body; and (d) a handle assembly having a base that is attached to the inner skirt of the seam ring, a handle that extends from the base, and a hinge between the base and the handle that allows the handle assembly to be pivoted from a position within the inner skirt of the seam ring to a position over the top portion and against the outer skirt of the seam ring.

2. The container of claim 1 wherein there are two hinges between the base and the handle assembly, the first of which pivots the handle assembly from within the inner skirt of the seam ring and the second of which pivots the handle assembly over the top of the seam ring.

3. The container of claim 1 wherein the handle assembly further includes a central member that is attached to the hinge between the base and the handle and which extends radially inwardly from the inner skirt when the handle assembly is in a position within the inner skirt of the seam ring and which abuts against the outer skirt of the seam ring when the handle is pivoted over the top portion.

4. The container of claim 3 wherein there are two handles and each handle is attached to the central member at a hinge to allow the handles to fold out from a position in which both handles and the central member are planar to a position in which the handles are folded against each other about the central member.

5. The container of claim 4 wherein each of the handles include first and second struts that extend perpendicular to the central member and a third strut that is substantially parallel to the central member and which joins the first and second struts, and wherein there are two hinges for each of the two handles that allow the handles to fold out against each other about the central member, the first of the two hinges being located at the junction of the first strut and the central member and a second of the two hinges being located at the junction of the second strut and the central member.

6. The container of claim 1 wherein the means for securing the seam ring to the container body are such as to make the seam ring not readily removable from the container body.

7. The container of claim 1 wherein the container body is formed of plastic, the closure comprises metal and is secured to the top of the container body by a double seam, and wherein the seam ring completely covers the double seam.

8. The container of claim 7 wherein the seam extends outwardly from the adjacent surface of the container body and the means for securing the seam ring to the container body includes an inwardly facing bead formed on the inner surface of the outer skirt which extends under the seam and holds the seam ring in position on the container body.

9. The container of claim 8 wherein the bead engages the seam.

10. The container of claim 1 wherein the top portion of the seam ring has a flat top surface and is substantially circular, wherein the outer skirt of the seam ring descends from the outer edge of the flat top surface portion, and wherein the inner skirt descends inwardly from the inner edge of the flat top surface portion.

11. The container of claim 1 wherein the container body is formed of a plastic material and the seam ring and the handle assembly are integrally formed of a plastic material selected from the group consisting of polypropylene and blends or co-polymers of polyolefins containing a polypropylene component.

12. The container of claim 1 wherein the container body is formed of a plastic material and the seam ring and the handle assembly are formed of a plastic material which has a heat distortion temperature higher than the the temperature at which the seam ring will be heated to during microwaving.

13. The container of claim 1 wherein the inner bottom edge of the inner skirt is positioned relative to the parting line such that when the area of the closure within the parting line is removed from the container, the inner bottom edge will protect a consumer from being cut by the edge of the closure remaining on the container body.

14. The container of claim 13 wherein the top peripheral edge portion of the container body is circular, the parting line and the closure is circular, and wherein the inner skirt of the seam ring terminates at a circular inner bottom edge which is spaced outwardly from the parting line in the closure no more than approximately twenty thousandths of an inch.

15. The container of claim 1 wherein the seam ring includes means for removably holding a splash panel above the bottom edge of the inner skirt wherein the splash panel is adaptive in size and shape to substantially cover the area within the inner skirt of the seam ring and the handle assembly when the handle assembly is positioned within the inner skirt.

16. The container of claim 15 wherein the means for removably holding a splash panel includes an inwardly extending support ledge on the seam ring for removably supporting a splash panel thereon.

17. The container of claim 16 further comprising a splash panel adapted in size and shape to be removably supported about its marginal edge portion on the ledge.

18. The container of claim 17 wherein the splash panel is made of material selected from the group consisting of plastic, paper, paperboard, cardboard, and combinations of the same.

19. The container of claim 15 wherein the means for removably holding includes means for supporting the splash panel and means restricting upward removal of the splash panel from the means for supporting.

20. The container of claim 15 wherein the means for removably holding a splash panel is located on the inner surface of the inner skirt of the seam ring.

21. The container of claim 15 wherein the means for removably holding a splash panel is located on the top portion of the seam ring.

22. The container of claim 19 wherein the means for supporting comprises an inwardly extending support ledge on the seam ring for removably supporting a splash panel thereon.

23. The container of claim 22 wherein the means for restricting upward removal of the splash panel includes a plurality of spaced lugs extending inwardly from the top portion of the seam ring such that the edge of the splash panel can be engaged between the support ledge and the lugs.

24. The container of claim 19 wherein the means for restricting includes an inward extension from the inner surface of the seam ring such that a channel is formed between the extended portion and the support ledge.

25. The container of claim 1 wherein the inner skirt extends downwardly upon or close to the closure and has an inner peripheral bottom edge which is spaced closely adjacent the parting line in the closure such that the area of the cover bounded by the parting line can be removed without interference from the inner skirt of the seam ring.

26. The container of claim 27 wherein the inner bottom edge is spaced outwardly of the parting line.

27. A seam ring adapted for use with a container of the type having a container body having a top peripheral edge portion defining the top opening of the container body and a closure joined to the top peripheral edge portion of the container by a seam to close the open top of the container body, the closure having a parting line at which the area within the parting line can be removed from the remainder of the closure, the seam ring comprising:

(a) a top portion;

(b) an outer skirt descending from the top portion, the outer skirt having an inner surface and a bottom edge;

(c) an inner skirt descending downwardly from the top portion to define with the outer skirt a channel within which the seam of a container can be enclosed, wherein the inner skirt has an inner bottom edge, the top portion, the inner skirt, and the outer skirt being integrally formed of plastic;

(d) a handle assembly having a base that is attached to the inner skirt of the seam ring, a handle that extends from the base, and a hinge between the base and the handle that allows the handle assembly to be pivoted from a position within the inner skirt of the seam ring to a position over the top portion and against the outer skirt of the seam ring; and (e) means for securing the seam ring to a container body.

28. The seam ring of claim 27 wherein there are two hinges between the base and the handle assembly, the first of which pivots the handle assembly from within the inner skirt of the seam ring and the second of which pivots the handle assembly over the top of the seam ring.

29. The container of claim 27 wherein the handle assembly further includes a central member that is attached to the hinge between the base and the handle and which extends radially inwardly from the inner skirt when the handle assembly is in a position within the inner skirt of the seam ring and which abuts against the outer skirt of the seam ring when the handle is pivoted over the top portion.

30. The container of claim 28 wherein there are two handles and each handle is attached to the central member at a hinge to allow the handles to fold out from a position in which both handles and the central member are planar to a position in which the handles are folded against each other about the central member.

31. The seam ring of claim 28 wherein each of the handles include first and second struts that extend perpendicular to the central member and a third strut that is substantially parallel to the central member and which joins with the first and second struts, and wherein there are two hinges for each of the two handles that allow the handles to fold out against each other about the central member, the first of the two hinges being located at the junction of the first strut and the central member and the second of the two hinges being located at the junction of the second strut and the central member.

32. The seam ring of claim 27 wherein the means for securing the seam ring to the container body are such as to make the seam ring not readily removable from the container body.

33. The seam ring of claim 32 wherein means for securing the seam ring to the container body includes an inwardly facing bead formed on the inner surface of the outer skirt which extends under the seam on the container body and holds the seam ring in position on the container body.

34. The seam ring of claim 27 wherein the top portion of the seam ring has a substantially flat top surface and is substantially circular, wherein the outer skirt of the seam ring descends from the outer edge of the top surface portion, and wherein the inner skirt descends inwardly from the inner edge of the flat top surface portion.

35. The seam ring of claim 27 wherein the seam ring and the handle assembly are integrally formed of a plastic material selected from the group consisting of polypropylene and blends or co-polymers of polyolefins containing a polypropylene component.

36. The seam ring of claim 27 wherein the seam ring and the handle assembly are integrally formed of a plastic material which has a heat distortion temperature higher than the temperature which the seam ring will be heated to during microwaving.

37. The seam ring of claim 33 wherein the outer surface of the outer skirt has a descending inwardly angled surface to make it difficult to remove the seam ring from the container body.

38. The seam ring of claim 27 wherein the inner skirt of the seam ring terminates at a circular inner bottom edge which will be spaced outwardly from the parting line and the closure no more than approximately twenty thousandths of an inch when the seam ring is mounted on a container body.

39. The seam ring of claim 27 including means for removably holding a splash panel above the bottom edge of the inner skirt wherein the splash panel is adapted in size and shape to substantially cover the area within the inner skirt of the seam ring.

40. The seam ring of claim 39 wherein the means for removably holding a splash panel includes an inwardly extending support ledge on the seam ring for removably supporting the splash panel thereon.

41. The seam ring of claim 40 further comprising a splash panel adapted in size and shape to be removably supported about is marginal edge portion on the ledge.

42. The seam ring of claim 40 wherein the splash panel is comprised of material selected from the group consisting of plastic, paper, paperboard, cardboard, and combinations of the same.

43. The seam ring of claim 39 wherein the means for removably holding includes means for supporting the splash panel and means for restricting upward removal of the splash panel from the means.

44. The seam ring of claim 39 wherein the means for removably holding a splash panel is located on the inner surface of the inner skirt.

45. The seam ring of claim 39 wherein the means for removably holding a splash panel is located on the top portion of the seam ring.

46. The seam ring of claim 45 wherein the means for supporting comprises an inwardly extending support ledge on the seam ring for removably supporting a splash panel thereon.

47. The seam ring of claim 46 wherein the means for restricting upward removal of the splash panel includes a plurality of spaced lugs extending inwardly from the seam ring such that the edge of the splash panel can be engaged between the support ledge and the lugs.

48. A container comprising:

(a) a container body having a top peripheral edge portion defining the top opening of the container and an outer surface; and (b) a handle assembly having a base that is attached to the container body proximate the top peripheral opening, the handle assembly including a central member about which two handles are attached, a first hinge positioned between the base and the central member that allows the handle assembly to be pivoted to a position on the outside of the outer surface, and a second hinge that folds the handles against each other about the central member to enable a user to grip the handles.

49. The container of claim 48 wherein each of the handles include first and second struts that extend perpendicular to the central member and a third strut that is substantially parallel to the central member and which joins the first and second struts, and wherein there are two hinges for each of the two handles that allow the handles to fold out against each other about the central member, the first of the two hinges being located at the junction of the first strut and the central member and a second of the two hinges being located at the junction of the second strut and the central member.

50. The container of claim 48 wherein the container body is packaged so that the handle assembly is positioned within the top peripheral edge portion and there are two hinges between the base and the handle assembly, the first of which pivots the handle assembly from within the top peripheral edge portion and the second of which pivots the handle assembly over the top of the top peripheral edge portion on the outside of the outer surface.

* * * * *